US011764534B2

(12) United States Patent
Li

(10) Patent No.: US 11,764,534 B2
(45) Date of Patent: Sep. 19, 2023

(54) TYPE C FEMALE SIDE CONNECTOR

(71) Applicant: Amphenol East Asia Electronic Technology (Shenzhen) Co., Ltd., Shenzhen (CN)

(72) Inventor: Kang-Qin Li, Shenzhen (CN)

(73) Assignee: Amphenol East Asia Electronic Technology (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 17/308,489

(22) Filed: May 5, 2021

(65) Prior Publication Data

US 2022/0360035 A1 Nov. 10, 2022

(51) Int. Cl.

*H01R 43/18* (2006.01)
*H01R 24/60* (2011.01)
*H01R 13/506* (2006.01)

(52) U.S. Cl.

CPC ..... *H01R 43/18* (2013.01); *H01R 13/506* (2013.01); *H01R 24/60* (2013.01)

(58) Field of Classification Search

CPC ..... H01R 12/716; H01R 13/4223; H01R 13/502; H01R 13/506; H01R 13/627; H01R 13/639; H01R 13/6581; H01R 43/18; H01R 24/60

See application file for complete search history.

(56) References Cited

U.S. PATENT DOCUMENTS 9,484,679 B2 11/2016 Guo et al.
9,509,084 B2 11/2016 Zhao et al.
9,553,410 B2 1/2017 Zhao et al.
9,685,728 B2 6/2017 Yao et al.
9,711,910 B2 7/2017 Zhao et al.
9,742,098 B2 8/2017 Zhao et al.
9,755,348 B2 9/2017 Guo et al.
9,768,544 B2 9/2017 Du et al.

(Continued)

FOREIGN PATENT DOCUMENTS

CN 101019277 A 8/2007
CN 102047507 A 5/2011

(Continued)

OTHER PUBLICATIONS

Chinese Office Action dated Oct. 8, 2018 in connection with Chinese Application No. 201580081064.1.

(Continued)

*Primary Examiner* — Oscar C Jimenez
(74) *Attorney, Agent, or Firm* — Wolf, Greenfield & Sacks, P.C.

(57) ABSTRACT

A Type C female side connector includes a terminal part, a body part, a steel plate, and a casing part; the terminal part is inserted in the body part; the body part is inserted in the casing part; the steel plate is inserted in the body part; the casing part has a suction portion formed in a flat plate structure on another side corresponding to an opening; the suction portion is integrated with the casing part; two sides of the suction portion expand to be sucked by a suck disc during manufacturing process. The present invention applies the suck disc portion to fulfill a sufficient area for automatic suction effect during manufacturing process, and includes a triple fix effect to strengthen the stability of the body part and the casing part.

20 Claims, 3 Drawing Sheets

(56) References Cited

U.S. PATENT DOCUMENTS

| | | | | |
|---|---|---|---|---|
| 9,774,130 | B2 | 9/2017 | Zhao et al. | |
| 9,806,475 | B2 | 10/2017 | Yao et al. | |
| 9,853,393 | B2 | 12/2017 | Guo et al. | |
| 9,871,317 | B2 | 1/2018 | Zhang et al. | |
| 9,871,318 | B2 | 1/2018 | Wang | |
| 9,893,459 | B2 | 2/2018 | Zhao et al. | |
| 9,954,303 | B2 | 4/2018 | Guo et al. | |
| 9,997,859 | B2 | 6/2018 | Yu | |
| 9,997,865 | B2 | 6/2018 | Yao | |
| 9,997,866 | B1 * | 6/2018 | Hsu | H01R 13/5202 |
| 10,044,148 | B2 | 8/2018 | Zhao | |
| 10,050,373 | B2 | 8/2018 | Wang | |
| 10,062,999 | B2 | 8/2018 | Yao et al. | |
| 10,096,932 | B2 | 10/2018 | Chang et al. | |
| 10,096,947 | B2 | 10/2018 | Cheng et al. | |
| 10,109,948 | B2 | 10/2018 | Zhao et al. | |
| 10,177,488 | B2 | 1/2019 | Zhao | |
| 10,193,271 | B2 | 1/2019 | Yu et al. | |
| 10,199,763 | B2 | 2/2019 | Zhu et al. | |
| 10,199,764 | B2 | 2/2019 | Wang | |
| 10,903,610 | B1 | 1/2021 | He et al. | |
| 10,910,747 | B1 | 2/2021 | He et al. | |
| 2010/0330849 | A1 * | 12/2010 | Wang | H01R 24/60 439/701 |
| 2011/0151716 | A1 | 6/2011 | Kondo | |
| 2012/0040562 | A1 * | 2/2012 | Zhu | H01R 13/506 439/626 |
| 2013/0178115 | A1 * | 7/2013 | Ao | H01R 13/6473 439/682 |
| 2015/0229075 | A1 | 8/2015 | Lin et al. | |
| 2016/0064879 | A1 | 3/2016 | Yen et al. | |
| 2017/0207570 | A1 | 7/2017 | Guo et al. | |
| 2017/0288333 | A1 | 10/2017 | Yao et al. | |
| 2017/0288360 | A1 | 10/2017 | Zhao et al. | |
| 2017/0302031 | A1 | 10/2017 | Cheng et al. | |
| 2017/0302037 | A1 | 10/2017 | Yao et al. | |
| 2017/0324187 | A1 | 11/2017 | Zhu et al. | |
| 2017/0338584 | A1 | 11/2017 | Yao | |
| 2017/0338585 | A1 | 11/2017 | Wang | |
| 2017/0338586 | A1 | 11/2017 | Wang | |
| 2017/0365961 | A1 * | 12/2017 | Zhao | H01R 24/60 |
| 2018/0019534 | A1 | 1/2018 | Yu | |
| 2018/0034195 | A1 | 2/2018 | Chang et al. | |
| 2018/0151983 | A1 | 5/2018 | Zhao | |
| 2018/0151987 | A1 | 5/2018 | Zhao | |
| 2018/0151988 | A1 | 5/2018 | Zhao | |
| 2018/0159267 | A1 | 6/2018 | Zhao | |
| 2018/0175562 | A1 | 6/2018 | Zhao | |
| 2018/0323548 | A1 | 11/2018 | Zhao | |
| 2018/0337489 | A1 | 11/2018 | Zhao | |
| 2018/0342839 | A1 | 11/2018 | Zhao et al. | |
| 2018/0351287 | A1 | 12/2018 | Zhao | |
| 2018/0358756 | A1 | 12/2018 | Zhao | |
| 2018/0375263 | A1 | 12/2018 | Zhong et al. | |

FOREIGN PATENT DOCUMENTS

| | | | |
|---|---|---|---|
| CN | 204243365 | U | 4/2015 |
| JP | 3196314 | U | 3/2015 |
| TW | M493185 | U | 1/2015 |
| WO | WO 2009/147791 | A1 | 12/2009 |

OTHER PUBLICATIONS

Chinese Office Action dated Jul. 4, 2019 in connection with Chinese Application No. 201580081064.1.

International Search Report and Written Opinion dated Mar. 22, 2016 in connection with International Application No. PCT/SG2015/050478.

International Preliminary Report on Patentability dated Nov. 9, 2017 in connection with International Application No. PCT/SG2015/050478.

No Author Listed], Universal Serial Bus Type-C Connectors and Cable Assemblies Compliance Document. Revision 2.1b. Jun. 2021. 86 pages.

He et al., Vehicle USB Type-C Connector, U.S. Appl. No. 17/337,047, filed Jun. 2, 2021.

* cited by examiner

TYPE C FEMALE SIDE CONNECTOR

BACKGROUND OF THE INVENTION

1. Field of the Invention

The present invention relates to Type C connectors, and more particularly, to a novel Type C female side connector.

2. Description of the Related Art

With continuously growing data storage amount, the requirement on the transmission rate becomes higher, which represents, in the field of server storage, the increase of clock frequent and the rapid decrease of the rising time. Such change imposes higher demand for the manufacture of connectors. Due to a circular shape on two sides of the casing of female side connectors, current Type C side connectors have a relatively small area for a suction of a suck disc, causing the SMT suck disc to be incapable of sucking the product, such that the operation performance of collaborating technical equipment remains slow and fails to fulfill the higher requirement of a new generation of Type C connectors.

SUMMARY OF THE INVENTION

To improve the issues above, the present invention discloses a Type C female side connector comprising a suction portion, which is different from conventional connectors.

For achieving the aforementioned objectives, a novel Type C female side connector is provided, comprising a terminal part, a body part, a steel plate, and a casing part; the terminal part is inserted in the body part, and comprises a dual-row pins structure arranged in a "7" shape; wherein the body part is inserted in the casing part; wherein the steel plate is inserted in the body part; one side of the casing part comprises an opening, through which the pins of the terminal part protrude out; the opening comprises a "7" shaped fix foot on two sides thereof; the casing part comprises a suction portion formed in a flat plate structure on another side corresponding to the opening; a middle portion of the suction portion is integrated with the casing part; two sides of the suction portion expand to form a flat structure, which is to be sucked by a suck disc during manufacturing process; one end of the terminal part is inserted in the body part, with another end of the terminal part protruding out from the opening of the casing part.

Preferably, the body part is formed of a plastic material and comprises a protrusion member and a body casing; the protrusion member is integrated with one end of the body casing; one side of the body casing connected with the protrusion member comprises a recess; the body casing has a groove on one side thereof.

Preferably, the casing part comprises an inward engagement protrusion corresponding to the recess; the casing part comprises a first inward engagement tongue matching the groove; the casing part comprises a second inward engagement tongue abutting against the protrusion member; therefore, a triple fix mechanism is achieved for stably fixing the body part in the casing part.

Preferably, the suction part comprises a fix portion and an expansion portion; the expansion portion is formed on two sides of the fix portion; the fix portion is integrated with the casing part; the expansion portion is formed of a portion of the casing part which is cut and expanded flatly.

Preferably, an outer side of the suction portion is a smooth face.

With such configuration, the present invention achieves following advantages.

Compared with conventional arts, the novel Type C female side connector is added with a suction portion, which is stamped to form an area fulfilling the suction demand for the suck disc, achieving an automatic suction effect. The present invention is provided with a triple fix mechanism, thereby strengthening the stability of the body part and the casing part, and resolving the insufficient operation performance during manufacturing process of a Type C female side connector.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

Figure 1:
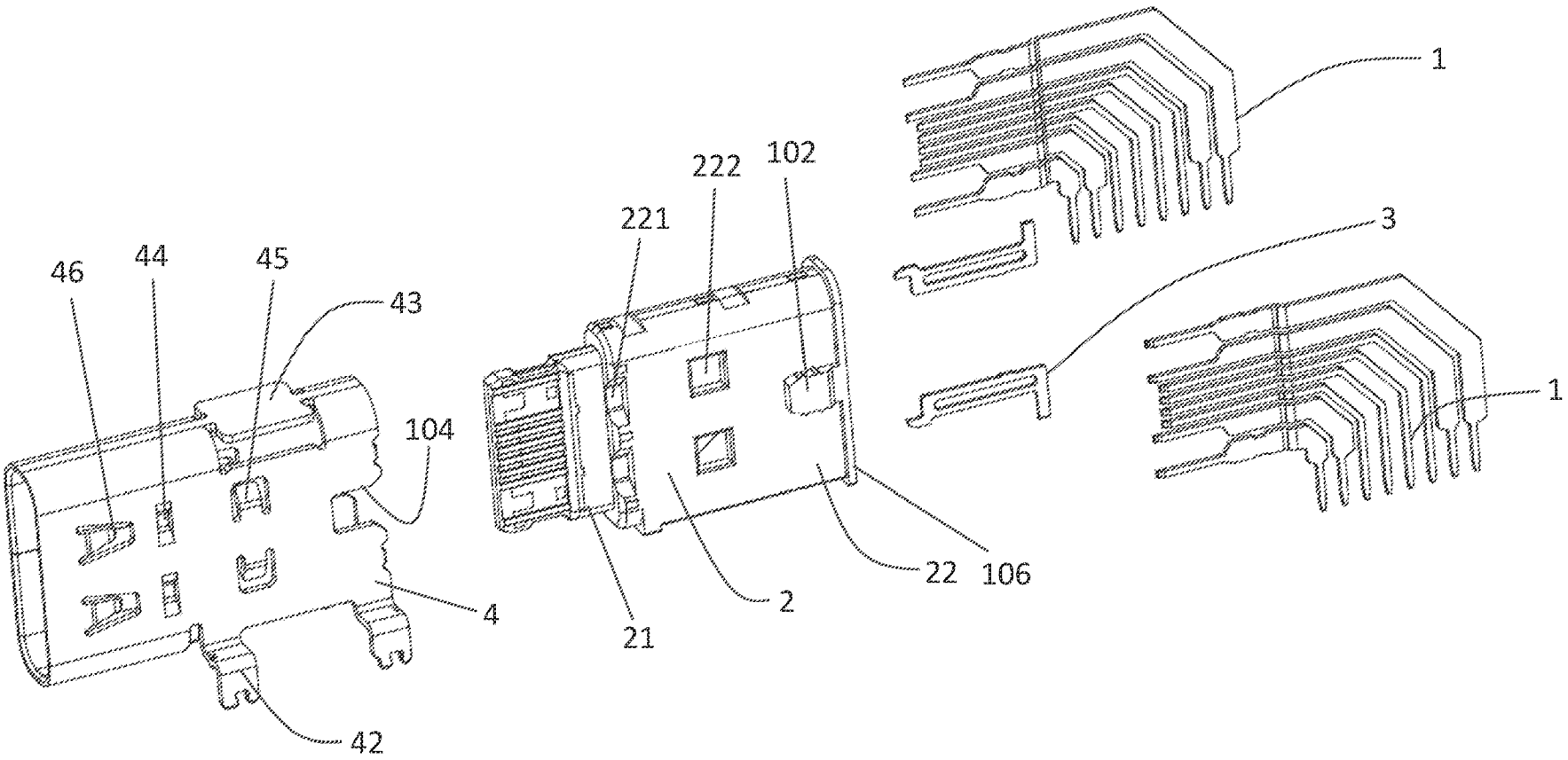
FIG. 1 is an exploded view of the Type C female side connector in accordance with an embodiment of the present invention.
Figure 2:
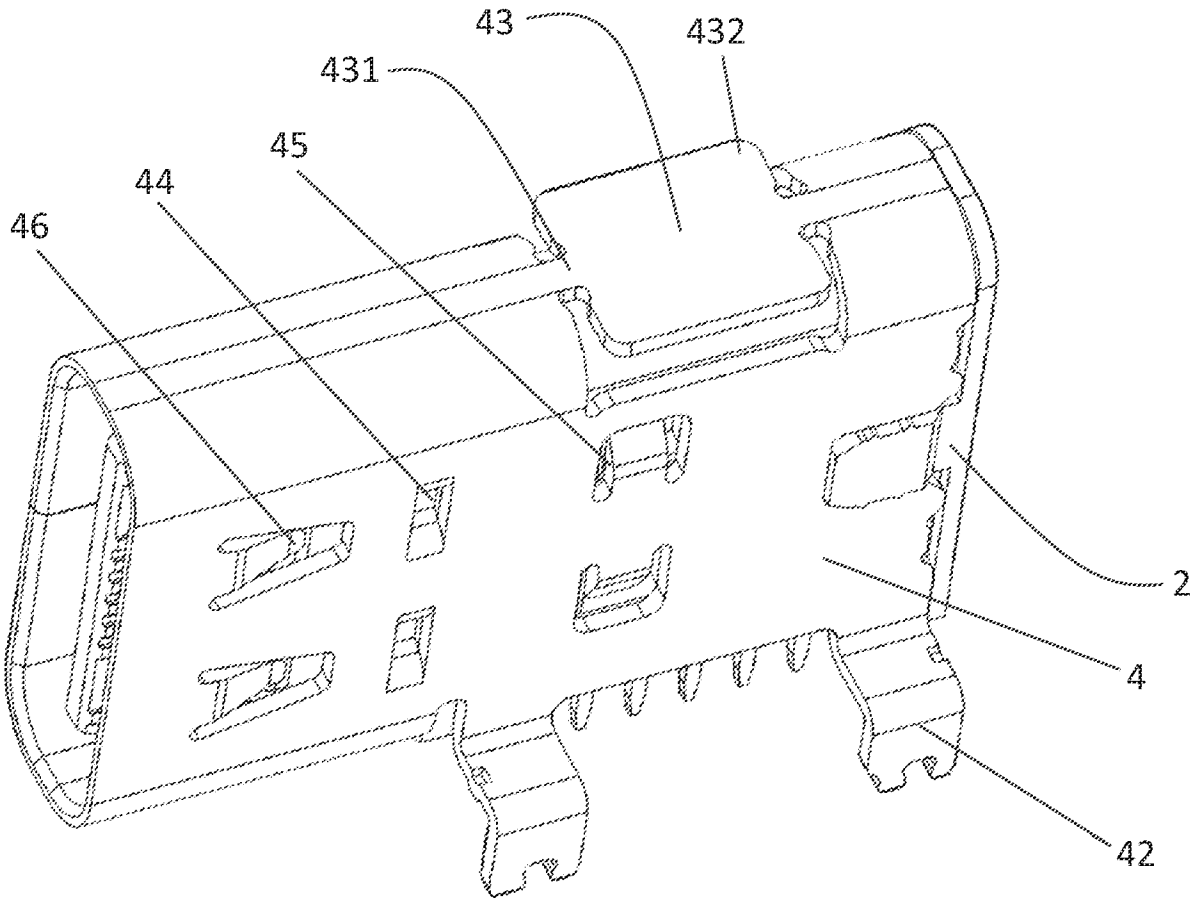
FIG. 2 is a perspective view of the Type C female side connector in accordance with an embodiment of the present invention.
Figure 3:
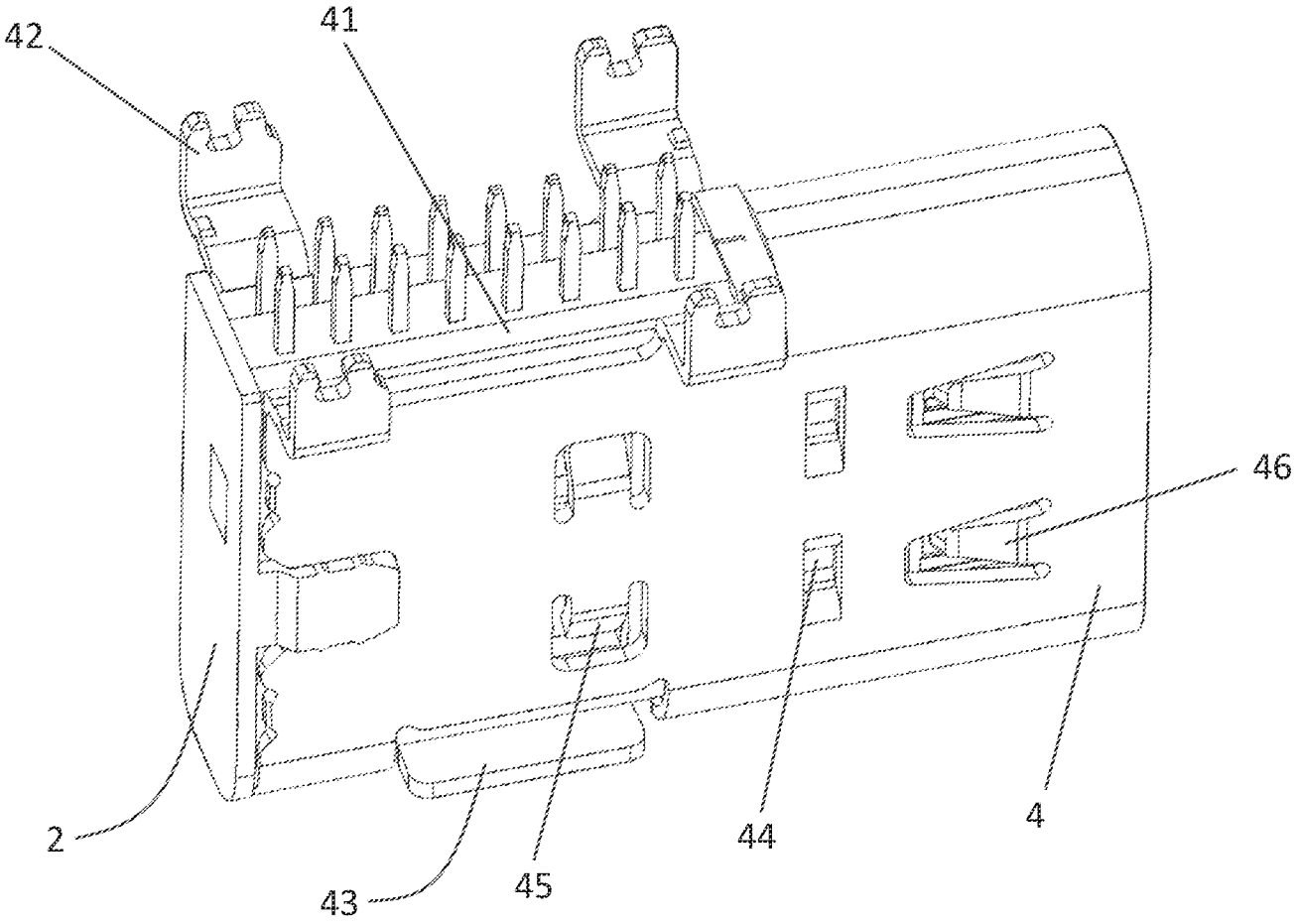
FIG. 3 is another perspective view of the Type C female side connector in accordance with an embodiment of the present invention.

Referring to FIG. 1 to FIG. 3, the present invention is described in detail with a specific embodiment. However, such embodiment does not limit the present invention.

Embodiment 1

Referring to FIG. 1 to FIG. 3, a novel Type C female side connector comprises a terminal part 1, a body part 2, a steel plate 3, and a casing part 4; the terminal part 1 is inserted in the body part 2, and comprises a dual-row pins structure arranged in a "7" shape; wherein the body part 2 is inserted in the casing part 4; wherein the steel plate 3 is inserted in the body part 2;

one side of the casing part 4 comprises an opening 41, through which the pins of the terminal part 1 protrude out; the opening 41 comprises a "7" shaped fix foot 42 on two sides thereof;

the casing part 4 comprises a suction portion 43 formed in a flat plate structure on another side corresponding to the opening 41; a middle portion of the suction portion 43 is integrated with the casing part 4; two sides of the suction portion 43 expand to form a flat structure, which is to be sucked by a suck disc during manufacturing; one end of the terminal part 1 is inserted in the body part 2, with another end of the terminal part protruding out from the opening of the casing part 4.

Referring to FIG. 1 to FIG. 3, preferably, the body part 2 is formed of a plastic material and comprises a protrusion member 21 and a body casing 22; the protrusion member 21 is integrated with one end of the body casing 22; one side of the body casing 21 connected with the protrusion member 21 comprises a recess 221; the body casing 22 has a groove 222 on one side thereof. The casing part 4 comprises an inward engagement protrusion 44 corresponding to the recess 221; the casing part 4 comprises a first inward engagement tongue 45 matching the groove 222; the casing part 4 comprises a second inward engagement tongue 46 abutting against the protrusion member 21; therefore, a triple fix mechanism is achieved for stably fixing the body part 2 in the casing part 4. As can be seen in FIG. 1 to FIG. 3, body casing 22 may include a projection 102, which may be elongated in an insertion direction, and a lip 106 at a rear end. The casing part 4 may include a channel 104 configured to engage the projection 102. The suction part 43 comprises a fix portion 431 and an expansion portion 432; the expansion portion 432 is formed on two sides of the fix portion 431; the fix portion 431 is integrated with the casing part 4; the expansion portion 432 is formed of a portion of the casing part 4 which is cut and expanded flatly. An outer side of the suction portion 43 is a smooth face.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A Type C female side connector, comprising a terminal part, a body part, a steel plate, and a casing part; wherein:

the terminal part is inserted in the body part, and comprises a dual-row pins structure arranged in a "7" shape;

the body part is inserted in the casing part;

the steel plate is inserted in the body part;

one side of the casing part comprises an opening, through which the pins of the terminal part protrude out;

the opening comprises a "7" shaped fix foot on two sides thereof;

the casing part comprises a suction portion formed in a flat plate structure on another side corresponding to the opening; a middle portion of the suction portion is integrated with the casing part; two sides of the suction portion expand to form a flat structure, which is to be sucked by a suck disc during manufacturing process;

the body part is formed of a plastic material and comprises a protrusion member and a body casing;

the protrusion member is integrated with one end of the body casing;

one side of the body casing comprises a pair of recesses;

the body casing has a pair of grooves on one side thereof;

the casing part comprises a pair of inward engagement protrusions corresponding to the pair of recesses and a pair of first inward engagement tongues matching the pair of grooves such that the body part is stably fixed in the casing part; and the pair of inward engagement protrusions are aligned with each other in a direction perpendicular to an insertion direction.

2. The Type C female side connector of claim 1, wherein one end of the terminal part is inserted in the body part, with another end of the terminal part protruding out from the opening of the casing part.

3. The Type C female side connector of claim 1, wherein the casing part comprises a pair of second inward engagement tongues.

4. The Type C female side connector of claim 1, wherein the suction part comprises a fix portion and an expansion portion; the expansion portion is formed on two sides of the fix portion; the fix portion is integrated with the casing part; the expansion portion is formed of a portion of the casing part which is cut and expanded flatly.

5. The Type C female side connector of claim 1, wherein an outer side of the suction portion is a smooth face.

6. An electrical connector, comprising:

a casing part comprising an opening at one end and a suction portion near an opposite end, the suction portion comprising a flat plate having sides with distal ends extending from a fixed middle portion;

a body part inserted in the casing part, the body part comprising a body casing and a protrusion member extending from the body casing; and a plurality of terminals inserted in the body part, each of the plurality of terminals comprising a mating end disposed adjacent the protrusion member of the body part, a contact tail extending out of the body part and perpendicular to the mating end, and an intermediate portion joining the mating end and the contact tail, wherein:

the casing part comprises a first inward engagement tongue and a second inward engagement tongue disposed adjacent the protrusion member of the body part;

the second inward engagement tongue has a proximal end and a distal end aligned in an insertion direction; and the proximal end is closer to the opening of the casing part than the distal end; and the first inward engagement tongue has a proximal end and a distal end aligned in a direction perpendicular to the insertion direction.

7. The electrical connector of claim 6, wherein:

the body part comprises a recess at a joint of the body casing and the protrusion member; and the casing part comprises an inward engagement protrusion engaging the recess at the joint of the body casing and the protrusion member.

8. The electrical connector of claim 7, wherein:

the recess is a first recess;

the inward engagement protrusion is a first inward engagement protrusion;

the body part comprises a second recess at the joint of the body casing and the protrusion member; and the casing part comprises a second inward engagement protrusion aligned with the first inward engagement protrusion in a direction perpendicular to the insertion direction and engaging the second recess at the joint of the body casing and the protrusion member.

9. The electrical connector of claim 6, wherein:

the body casing of the body part comprises a groove; and the a first inward engagement tongue of the casing part engages the groove of the body casing of the body part.

10. The electrical connector of claim 9, wherein:

the groove is a first groove;

the second inward engagement tongue having the proximal end and the distal end aligned in the direction perpendicular to the insertion direction is a first first inward engagement tongue;

the body casing of the body part comprises a second groove; and the casing part comprises a second first inward engagement tongue having a proximal end and a distal end aligned in the direction perpendicular to the insertion direction and engaging the second groove of the body casing of the body part.

11. The electrical connector of claim 10, wherein:

the proximal end of the second first inward engagement tongue is closer to the proximal end of the first inward engagement tongue than the distal end of the second first inward engagement tongue.

12. The electrical connector of claim 10, wherein:

the second inward engagement tongue and the first second inward engagement tongue are aligned in the direction perpendicular to the mating direction.

13. The electrical connector of claim 6, wherein:

the casing part comprises a plurality of "7" shaped foots extending downwards from opposite sides.

14. The electrical connector of claim 6, wherein:

the electrical connector is a USB Type-C female side connector.

15. The electrical connector of claim 6, wherein:

the second inward engagement tongue is a first second inward engagement tongue;

the casing part comprises a second inward engagement tongue disposed adjacent the protrusion member of the body part; and the second inward engagement tongue has a proximal end aligned with the proximal end of the first second inward engagement tongue in a direction perpendicular to the insertion direction and a distal end aligned with the distal end of the first second inward engagement tongue in the direction perpendicular to the mating direction.

16. The electrical connector of claim 6, wherein:

the body casing of the body part comprises a lip at a rear end configured to constrain movement of the casing part.

17. An electrical connector comprising:

a casing part;

a body part inserted in the casing part, the body part comprising a body casing and a protrusion member extending from the body casing; and a plurality of terminals inserted in the body part, each of the plurality of terminals comprising an insertion end disposed adjacent the protrusion member of the body part, a contact tail extending out of the body part and perpendicular to the mating end, and an intermediate portion joining the mating end and the contact tail, wherein:

the body casing of the body part comprises a pair of grooves, a lip at a rear end of the body casing, and a projection extending from the lip and elongated in an insertion direction;

the casing part comprises a pair of first inward engagement tongues engaging the pair of grooves, respectively, an opening at a rear end, and a channel engaging the projection; and the lip of the body casing abuts a perimeter of the opening of the casing part.

18. The electrical connector of claim 17, wherein:

the pair of grooves extend perpendicular to the projection and in opposite directions.

19. The electrical connector of claim 18, wherein:

the casing part comprises a pair of second inward engagement tongues disposed adjacent the protrusion member of the body part; and each of the pair of second inward engagement tongues extends in the mating direction and has a distal end closer to the projection than a proximal end.

20. The electrical connector of claim 19, wherein:

the body part comprises a pair of recesses at a joint of the body casing and the protrusion member; and the casing part comprises a pair of inward engagement protrusions engaging the pair of recesses, respectively.

* * * * *